US008511486B2

(12) United States Patent
Mansor

(10) Patent No.: US 8,511,486 B2
(45) Date of Patent: Aug. 20, 2013

(54) OVERHEAD RACK STORAGE SYSTEM

(76) Inventor: Todd Mansor, Phoenix, AZ (US)

( * ) Notice: Subject to any disclaimer, the term of this patent is extended or adjusted under 35 U.S.C. 154(b) by 447 days.

(21) Appl. No.: 12/692,361

(22) Filed: Jan. 22, 2010

(65) Prior Publication Data

US 2011/0182704 A1 Jul. 28, 2011

(51) Int. Cl.
*A47F 5/08* (2006.01)

(52) U.S. Cl.
USPC ..... 211/117

(58) Field of Classification Search
USPC ..... 211/117, 175, 113, 208, 118, 119, 211/189, 207, 181.1; 108/48, 42, 149, 186; 52/39; 248/317, 323, 326, 327, 343
See application file for complete search history.

(56) References Cited

U.S. PATENT DOCUMENTS

| | | | | | |
|---|---|---|---|---|---|
| 2,057,092 | A * | 10/1936 | Geib | 182/113 |
| 3,139,045 | A * | 6/1964 | Rojakovick | 108/109 |
| 3,735,951 | A * | 5/1973 | Reed | 248/340 |
| 3,945,462 | A * | 3/1976 | Griswold | 182/150 |
| 4,441,583 | A * | 4/1984 | Vaught | 182/150 |
| 6,145,678 | A * | 11/2000 | Morrison | 211/113 |
| 6,409,031 | B1 * | 6/2002 | Wynne | 211/119 |
| D459,926 | S * | 7/2002 | Mikich et al. | D6/513 |
| 6,435,105 | B1 * | 8/2002 | Mikich et al. | 108/42 |
| 6,715,427 | B2 * | 4/2004 | Mikich et al. | 108/42 |
| 6,725,608 | B1 * | 4/2004 | Kraus | 52/36.4 |
| 7,152,535 | B2 * | 12/2006 | Mikich et al. | 108/42 |
| 7,357,262 | B2 * | 4/2008 | Fratilla | 211/117 |
| 7,543,538 | B2 * | 6/2009 | Baez | 108/42 |
| 7,810,438 | B2 * | 10/2010 | Ryberg | 108/42 |
| 8,066,131 | B2 * | 11/2011 | Mansor et al. | 211/117 |
| 2002/0023888 | A1 * | 2/2002 | Wynne et al. | 211/119 |
| 2004/0182291 | A1 * | 9/2004 | Mikich et al. | 108/149 |
| 2006/0070967 | A1 * | 4/2006 | Schaubeck et al. | 211/187 |
| 2007/0007223 | A1 * | 1/2007 | Thrush et al. | 211/118 |
| 2007/0119805 | A1 * | 5/2007 | Nawrocki | 211/119 |
| 2007/0205169 | A1 * | 9/2007 | Fratilla | 211/117 |

* cited by examiner

*Primary Examiner* — Jennifer E Novosad

(57) ABSTRACT

An overhead rack system is provided that may be mounted to the ceiling of a structure such as a garage for storing items in an organized manner off the floor. Overhead rack system is designed to make use of a garage's previously unused ceiling space, allowing home owners to store their items overhead and out of the way. The system is ideally configured for storing large or heavy items that otherwise can quickly fill a garage's available floor space.

21 Claims, 14 Drawing Sheets

FIG. 1

OVERHEAD RACK STORAGE SYSTEM

FIELD OF THE INVENTION

The present invention is directed to overhead storage products that utilize unused ceiling space to create additional storage in homes. More specifically, the present invention is directed to a modular overhead storage system having a horizontal bike/package lift and motorized lift system that utilizes a plurality of C-mount support bracket members for supporting the side rails of a rack member.

BACKGROUND

There are many houses with a two car garage that have never had two cars in them. Instead of using that space to shield cars from the sun and harsh weather, the garage has become home to a collection of gardening and lawn equipment, tools, woodworking equipment, cast-off furniture and things that are no longer used, but are not throw away. Finding items that are needed in a cluttered garage is a complicated process. Usually, it starts with edging between the stacks of boxes and miscellaneous equipment. If the home owner is lucky, they may remember where this particular item was last, or which box it may be located. More often, it becomes a process of elimination that involves knowing what went into the garage during which time period and playing 'hot, hot, cold' until that person stumbles upon what they're trying to locate. Overhead garage storage can transform unused space in a garage into fully functional storage space. Whether looking to store holiday decorations, sports equipment or mementos, these items can easily fit in a garage if the proper storage racks are in place.

SUMMARY

In one embodiment, an overhead storage system is provided comprising an overhead rack system, a motorized lift system and a horizontal storage system. The overhead rack system has a plurality of rack mounting tracks configured for securing the overhead rack system to the ceiling joists of a structure. The rack system also includes a rack member having a first side rail platform and a second side rail platform. The first and second side rail platforms are coupled together by a plurality of rail connectors to form a substantially rectangular frame member. The substantially rectangular frame member has a channel running along its perimeter that is configured to receive and support a drop-in grid assembly that is for supporting items to be stored thereon. The rack system further includes a plurality of support bracket members coupled to the plurality of mounting tracks, configured to attach to the rack member.

The horizontal storage system is comprised of a storage system mounting track, a plurality of upper beam members, a plurality of lower beam members and a base channel assembly. The storage system mounting track is configured for securing the overhead rack system to the overhead rack system. The plurality of upper beam members is secured to the storage system mounting track. The plurality of lower beam members is pivotally connected to the plurality of upper beam members using a cam and channel assembly and spring-assist lift system. The base channel assembly is coupled to the plurality of lower beam members for supporting items when moving the horizontal storage system between a substantially vertical loading position and a substantially horizontal storing position.

The motorized lift system has a lift platform, a motor and winch assembly and a track rail. The lift platform is configured to receive an item to be stored on the rack member of the overhead rack system. The lift platform also has a stabilizer edge for engaging the side rail platforms of the rack member. The motor and winch assembly has a plurality of truck wheels and a cable disposed therein. The cable is coupled to the lift platform. The motor and winch assembly is operable to move the lift platform between a loading position and an unloading position adjacent the rack member of the overhead rack system. The tack rail is mounted adjacent the rack member of the overhead rack system and configured to receive the truck wheels of the motor and winch assembly. The track rail is configured to provide a guide for moving the lift platform along the length of one side of the substantially rectangular frame member.

DETAILED DESCRIPTION

In the following description, numerous specific details are set forth, such as examples of the overhead rack system, bike lift system, package lift system and motorized lift system, in order to provide a thorough understanding of the present invention. It will be apparent, however, to one skilled in the art that the present invention may be practiced without these specific details. In other instances, well known components or methods have not been described in detail but rather in a general manner in order to avoid unnecessarily obscuring the present invention. Thus, the specific details set forth are merely exemplary. The specific details may be varied from and still be contemplated to be within the spirit and scope of the present invention.

It should be appreciated that reference throughout this specification to "one embodiment" or "an embodiment" or "one example" or "an example" means that a particular feature, structure or characteristic described in connection with the embodiment may be included, if desired, in at least one embodiment of the present invention. Therefore, it should be appreciated that two or more references to "an embodiment" or "one embodiment" or "an alternative embodiment" or "one example" or "an example" in various portions of this specification are not necessarily all referring to the same embodiment. Furthermore, the particular features, structures or characteristics may be combined as desired in one or more embodiments of the invention. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
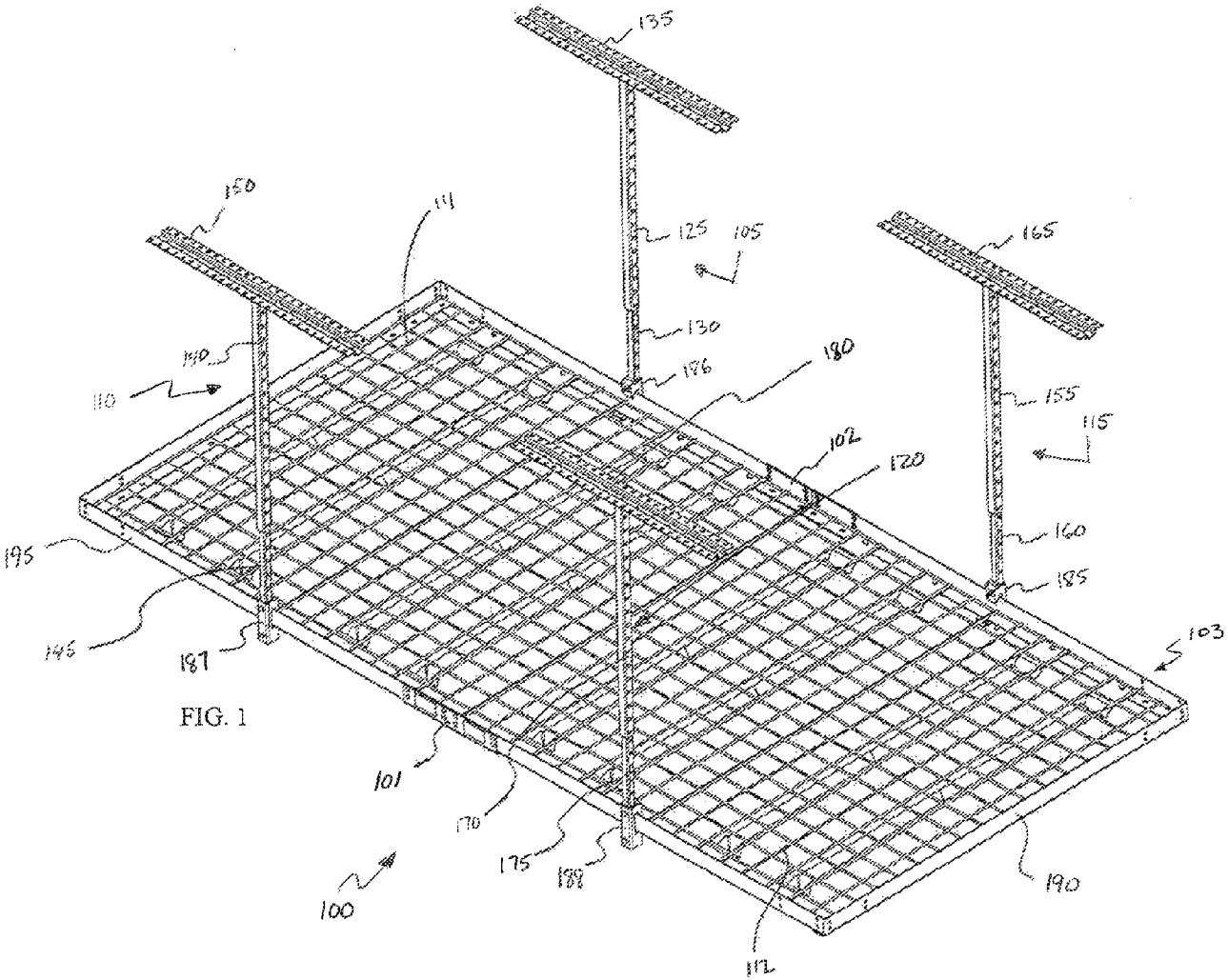
FIG. 1 is a perspective view of one embodiment of an overhead rack system.

FIG. 1 illustrates one embodiment of an overhead rack system 100. Overhead rack system 100 is constructed to be mounted to the ceiling of a garage for storing items in an organized manner off the floor. Overhead rack system 100 provides a way to maximize a home's available storage space. Rack system 100 is designed to make use of a garage's previously unused ceiling space, allowing home owners to store their items overhead and out of the way. The system is ideally configured for storing large or heavy items that otherwise can quickly fill a garage's available space. Plastic storage bins, or boxes that could quickly clutter available garage floor space fit perfectly on overhead rack 100, helping to maximize available space.

In the illustrated embodiment of FIGS. 1-4, overhead rack system 100 is generally comprised of four rack mounting tracks 105, 110, 115, 120 and a rack member 103. Rack mounting tracks 105, 110, 115, 120 are further comprised of ceiling mount 135, 150, 165, 180 coupled to upper bracket members 125, 140, 155, 170 respectively. Ceiling mounts 135, 150, 165, 180 are adapted to be mounted to the ceiling of a garage, and shall be manufactured of a material strong enough to support the weight of the rack and the items that will be stored thereon. Lower extension assembly 130, 145, 160, 175 are disposed within the interior of upper bracket members 125, 140, 155, 170 so as to create a telescoping mounting track 105, 110, 115, 120, thereby adjusting the location of the rack member relative to the ceiling mounts 135, 150, 165, 180.

Rack member 103 comprises a first side rail platform 190 coupled to a second side rail platform 195 using a plurality of rail connectors 101, 102. The rack member 103 is configured to support any number of differing sized items utilizing one or more drop-in grid assembly 111, 112. The strength of the connection formed by rail connectors 101, 102 provides the means to allow the rack member 103 to be shipped in a smaller container, since a single side rail member running the length of the first an second side rail platform would be twice as long as shipping them separate and connecting them together using the firs rail connector 101 and second rail connector 102.

Figure 1A:
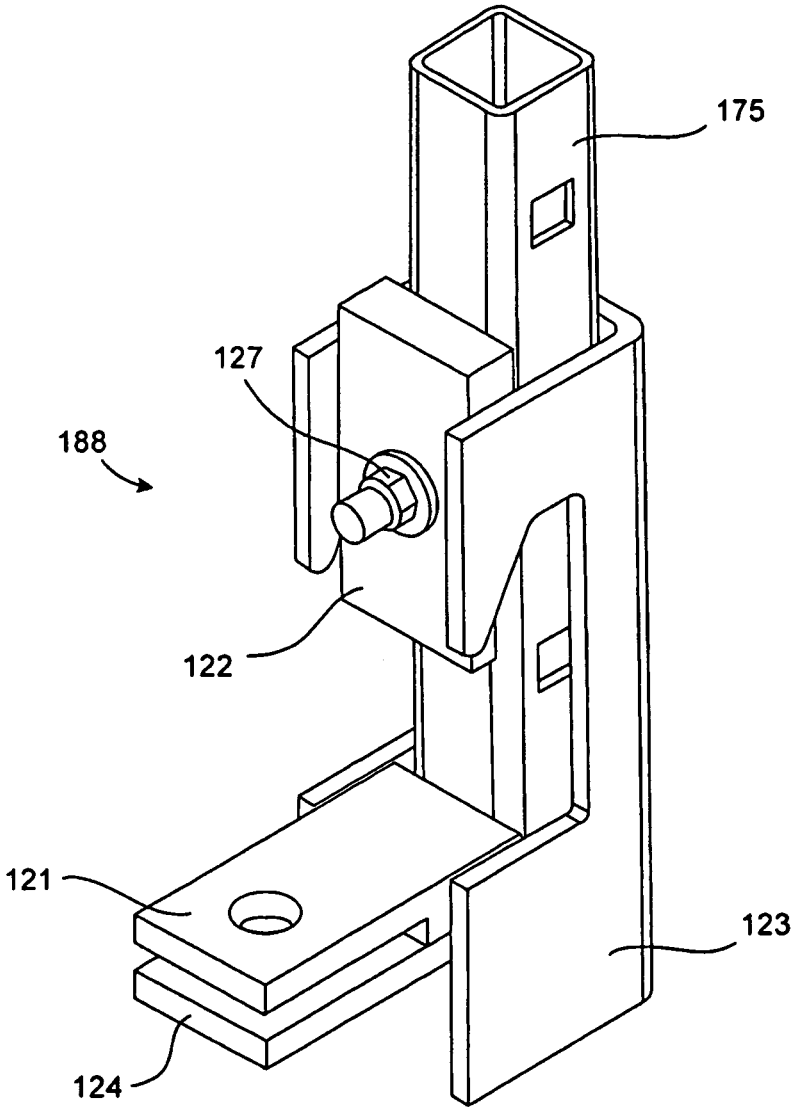
FIG. 1A is a perspective view of a support bracket member.
Figure 19:
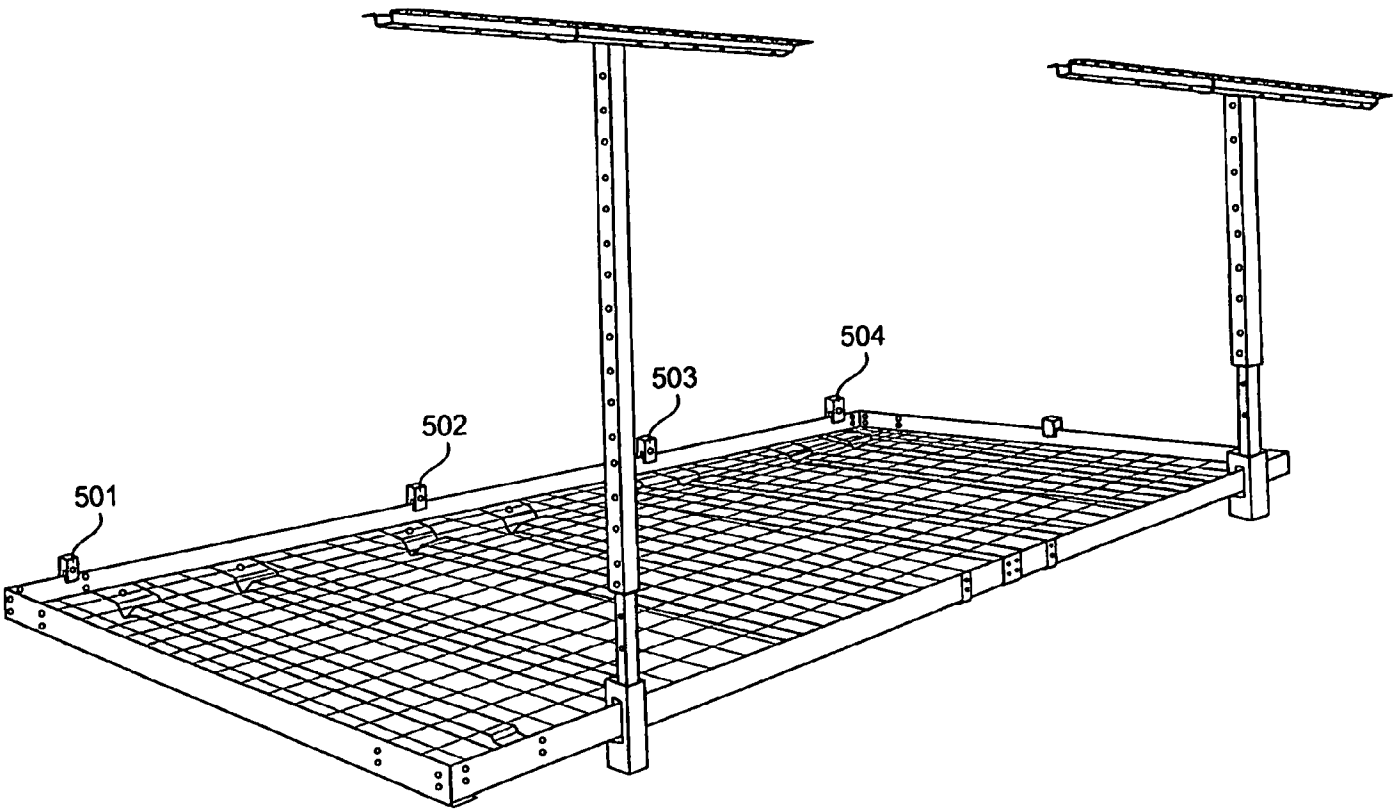
FIG. 19 illustrates an alternate embodiment of an overhead rack system with the C-mount support bracket members on one side mounted to the wall studs.

A plurality of C-mount support bracket members 185, 186, 187, 188 are coupled to one end of the respective lower extension assembly 130, 145, 160, 175 for joining the four mounting tracks 105, 110, 115, 120 to the rack member 103. FIG. 1A illustrates C-mount support bracket member 188 in greater detail. Support bracket member 188 is generally comprised of a wall and rail bracket 123, a rack member support mount 121 coupled to a tab member 124 and a lower extension assembly mount 122. C-mount support bracket member 188 is adapted to support the weight of ¼ of the maximum weight intended to be stored on rack member 103. In the illustrated embodiment, lower extension assembly mount 122 is configured to be connected to the lower extension assembly 175. FIG. 19 illustrates an alternate embodiment of an overhead rack system 500 with a plurality of C-mount support bracket members 501, 502, 503, 504 on one side mounted to the wall studs.

In the embodiment of FIG. 1A, the support bracket member 188 is coupled to the lower extension assembly 175 using a nut and bolt assembly 127. One of ordinary skill in the art will appreciate that any mounting means may be used without departing from the intended scope and spirit of the present invention. Continuing with the illustrated embodiment, as shown in FIGS. 1-4, the side rail of first side rail platform 190 would be inserted into the upper U-shaped area of the wall and rail bracket 123. The rack member 103, and more specifically the rail member of the first side rail platform 190, is supported by the combination of the rack member support mount 121 and tab member 124. FIG. 19 illustrates an alternate embodiment of an overhead rack system 500 with a plurality of C-mount support bracket members 501, 502, 503, 504 on one side mounted to the wall studs. This wall mounted overhead garage rack 500 is a variation of overhead rack system 100, but can hold more weight and can be mounted to a combination of ceiling and walls.

Figure 2:
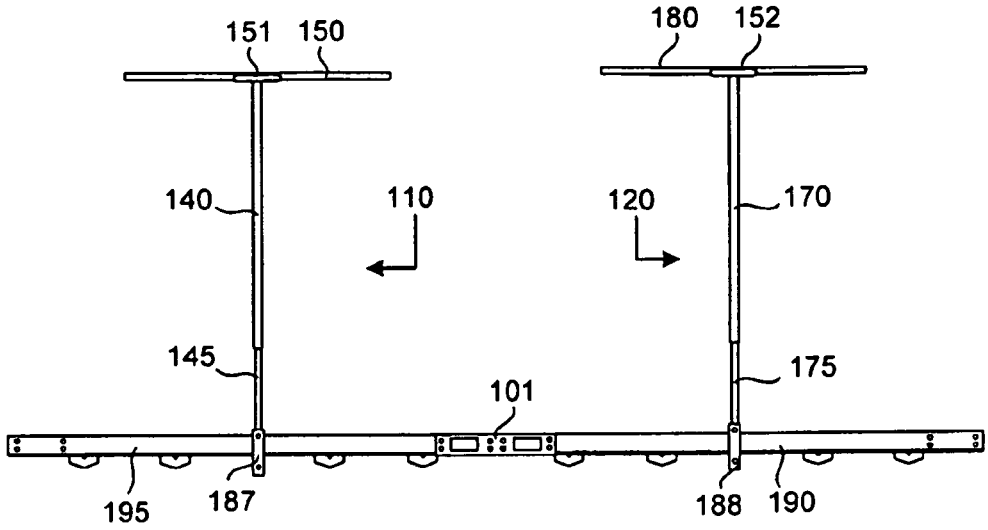
FIG. 2 is a front view showing certain elements of the embodiment of an overhead rack system illustrated in FIG. 1.
Figure 3:
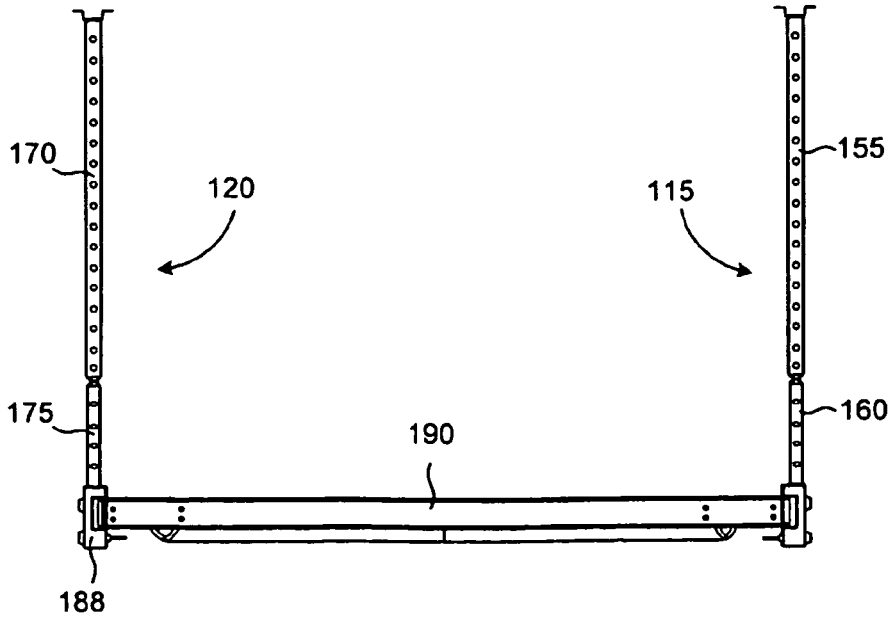
FIG. 3 is a side view showing certain elements of the embodiment of an overhead rack system illustrated in FIG. 1.

FIGS. 2 and 3 further illustrate a side and front view of the overhead rack system 100. FIG. 2 shows a front view of two mounting track members 110, 120. Mounting track members 110 is comprised of a ceiling mount 150 connected to an upper bracket member 140, which serves as one of the four mounting foundations for the rack system 100. In the illustrated embodiment, ceiling mount 150 is coupled to the upper bracket member 140 using a mounting track U-bend 151 that is attached to the ceiling mount 150 and welded to the upper bracket member 140. It should be appreciated by one of ordinary skill in the art that any means for connecting the ceiling mount 150 to the upper bracket member 140 may be utilized. Lower extension assembly 145 is configured to fit within the interior of upper bracket member 140 so as to create a telescoping mounting track member 110.

In the illustrated embodiment, lower extension assembly 145 and upper bracket member 140 are constructed of square tubing with a plurality of holes configured to receive a plurality of bolt assemblies (not shown). The square tubing of the upper bracket member 140 is sized to be slightly larger in diameter than the square tubing of the lower extension assembly 145 so that the lower extension assembly 145 fits within the upper bracket member 140 and is configured to move relative thereto in a telescoping manner. The telescoping relationship between the upper bracket member 140 of fixed mounting track member 110 relative to the lower extension assembly 145 allows a user to adjust the distance between the ceiling and the second side rail platform 195 of rack member 103. The bolt assemblies are mounted through matching holes in each, so as to secure the lower extension assembly 145 to the upper bracket member 140 in a user chosen position and thus form a single, rigid mounting track member 110 from the multi-piece construction of parts. A similar construction is contemplated for mounting track 105, which is also coupled to the second side rail platform 195 of rack member 103.

Continuing with the illustrated embodiment of FIGS. 2 and 3, mounting track member 120 is comprised of a ceiling mount 180 connected to an upper bracket member 170, which also serves as one of four mounting foundations for the rack system 100. In the illustrated embodiment, ceiling mount 180 is coupled to the upper bracket member 170 using a mounting track U-bend 152 that is attached to the ceiling mount 180 and welded to the upper bracket member 170. It should be appreciated by one of ordinary skill in the art that any means for connecting the ceiling mount 180 to the upper bracket member 170 may be utilized. Lower extension assembly 175 is configured to fit within the interior of upper bracket member 170 so as to create a telescoping mounting track member 120.

In the illustrated embodiment, lower extension assembly 175 and upper bracket member 170 are constructed of square tubing with a plurality of holes configured to receive a plurality of bolt assemblies (not shown). The square tubing of the upper bracket member 170 is sized to be slightly larger in diameter than the square tubing of the lower extension assembly 175 so that the lower extension assembly 175 fits within the upper bracket member 170 and is configured to move relative thereto in a telescoping manner. The telescoping relationship between the upper bracket member 170 of fixed mounting track member 120 relative to the lower extension assembly 175 allows a user to adjust the distance between the ceiling and the first side rail platform 190 of rack member 103. The bolt assemblies are mounted through matching holes in each, so as to secure the lower extension assembly 145 to the upper bracket member 140 in a user chosen position and thus form a single, rigid mounting track member 110 from the multi-piece construction of parts. A similar construction is contemplated for mounting track 115, which is also coupled to the first side rail platform 190 of rack member 103.

Figure 3A:
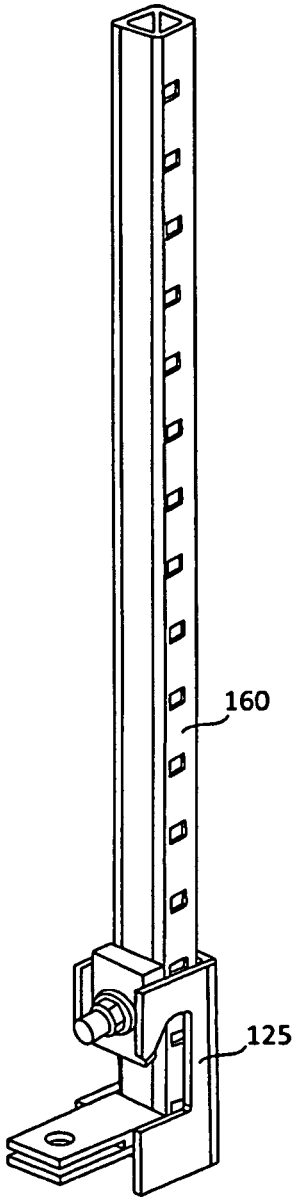
FIG. 3A is a perspective view of the combination of a support bracket member and a lower extension assembly.

FIG. 3 illustrates a side view of one particular example of a plurality of telescoping mounting track members 115, 120 supporting the first side rail platform 190 of rack member 103 utilizing a plurality of support bracket members 185, 188. In this view, the mounting relationship between the support bracket members 185, 188 and the first side rail platform 190 of rack member 103 is shown. The rack member 103, and more specifically the rail member of the first side rail platform 190, is supported by the combination of the rack member support mounts and tab members (not shown) of support bracket members 185, 188. In one embodiment, the rail member of the first side rail platform 190 is coupled to the rack member support mounts and tab members of support bracket members 185, 188 using a bolt assembly. FIG. 3A illustrates the combination support bracket member 185 and lower extension assembly 160 in greater detail.

Figure 4:
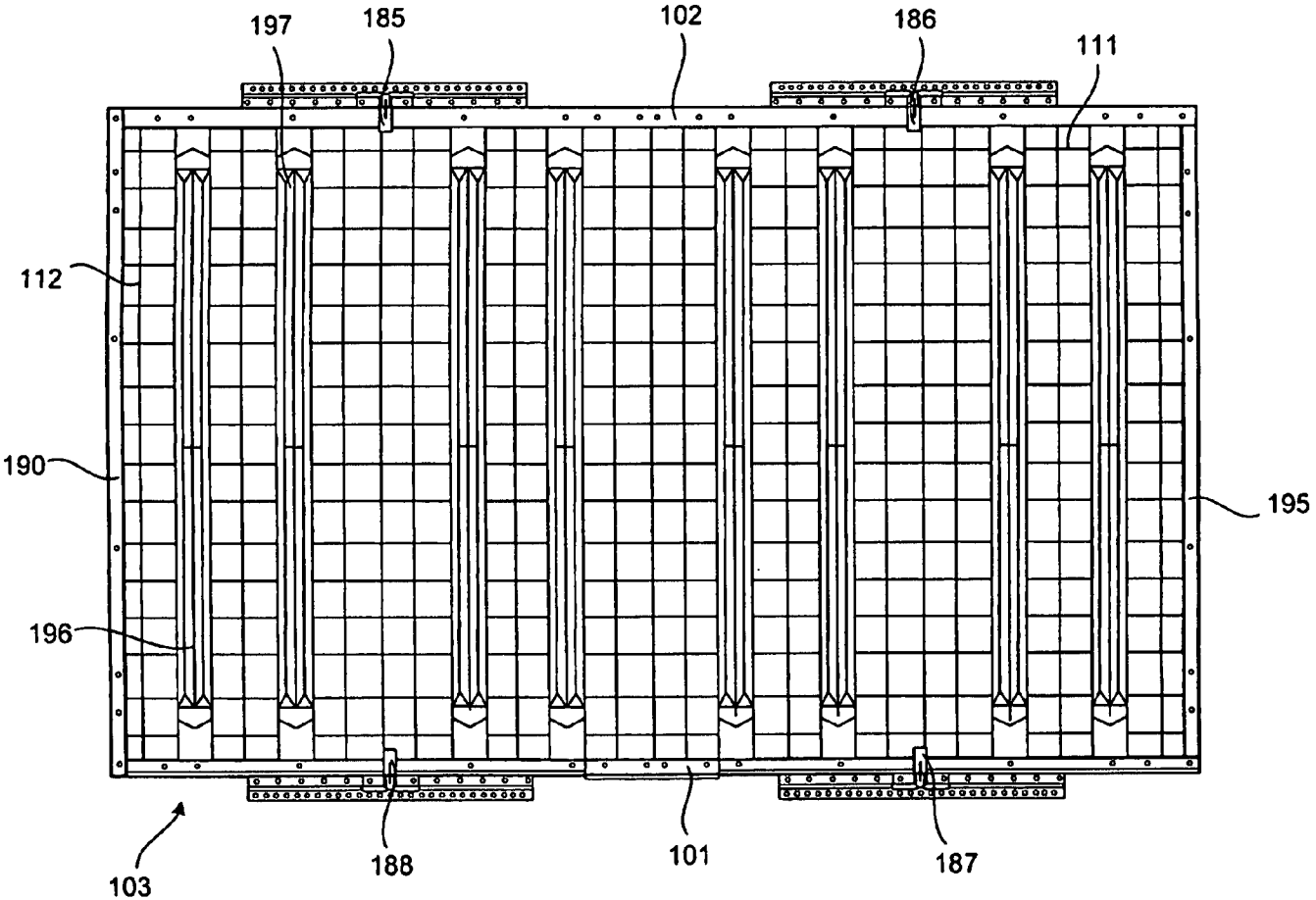
FIG. 4 is a bottom view of the embodiment of an overhead rack system illustrated in FIG. 1.

FIG. 4 shows the underside of the rack member 103. In the illustrated embodiment, a plurality of grid stiffeners 196, 197 are used to give support and strength to the rack member 103. Grid stiffeners 196, 197 provide both additional structure to the first side rail platform 190 and second side rail platform 195 for purposes of strengthening each as well as support for items placed on drop in grid members 111, 112 so that the grid members do not sag and become detached from the first and second side rail platforms.

FIGS. 5-9 illustrate one embodiment of a horizontal bike storage system 200 that may be used in connection with the overhead rack system 100 illustrated and described with respect to FIGS. 1-4. In one embodiment, the horizontal bike storage system 200 is constructed using 14 gage powder coated steel, can handle bikes from 1' to 6' up to 150 pounds, and can be mounted to the garage ceiling taking up little garage ceiling storage space. The horizontal bike storage system 200 of the present invention is intended to be a ceiling mounted bike rack that uses a spring-assist lift system to store a bike horizontally, which is in contrast to similar bike racks that store the bike vertically, allowing for little or no room to walk underneath the bike, and causing the garage to be difficult to navigate. Since the horizontal bike storage system 200 is so compact, it can also easily be used as a bike storage accessory mounted under overhead rack system 100.

Unlike bike racks that simply hang the bike from the ceiling or wall, the horizontal bike storage system 200 folds a bike flat against the ceiling or bottom of overhead rack system 100, and, in the illustrated embodiment, occupies approximately 20-26 inches of hanging ceiling space. Furthermore, the spring-assist lift system ensures that the user will easily be able to fold a bike to the ceiling, making this bike storage system extremely compact and easy to use. The horizontal bike storage system 200 is ideal for low profile ceilings, as it keeps the bike folded flat to the ceiling. Such an arrangement allows for more garage clearance, and utilizes un-used garage ceiling space.

Figure 5:
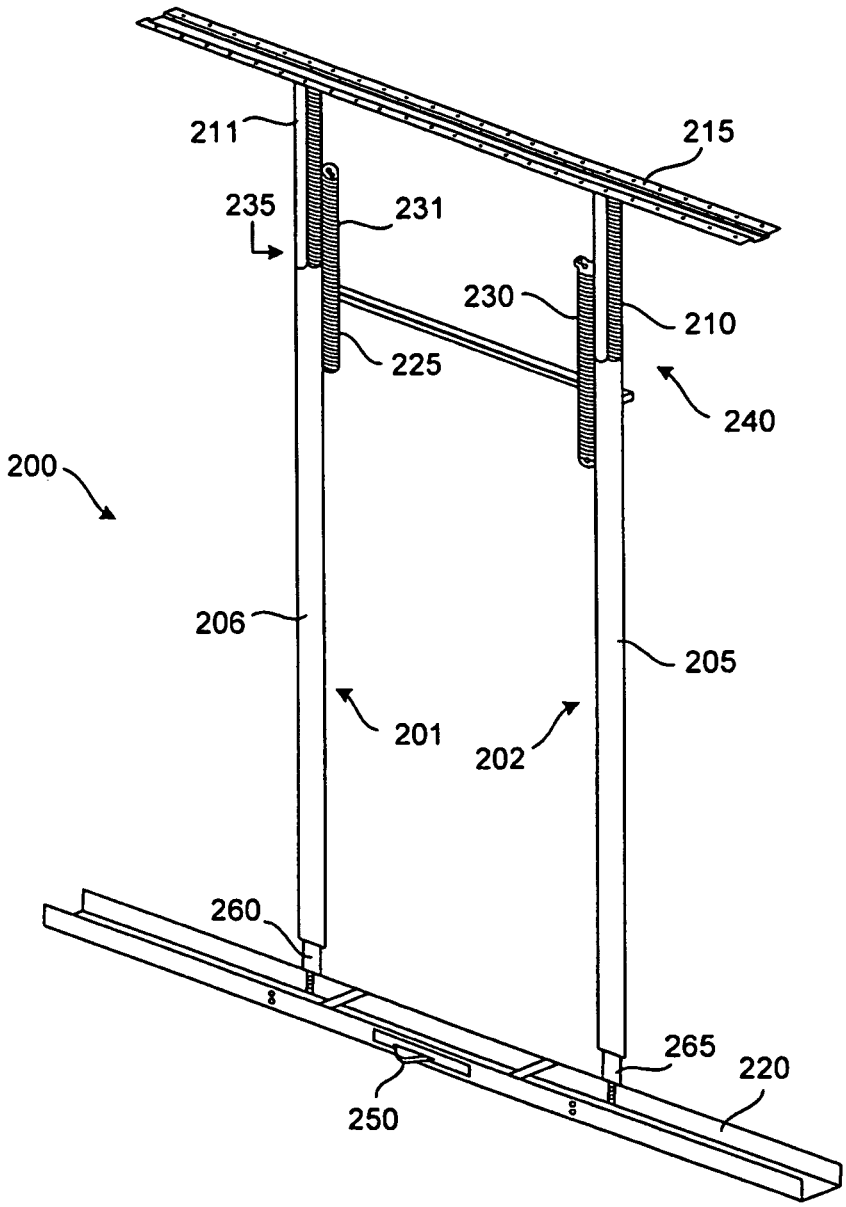
FIG. 5 is a perspective view of one embodiment of a horizontal bike storage system.
Figure 9:
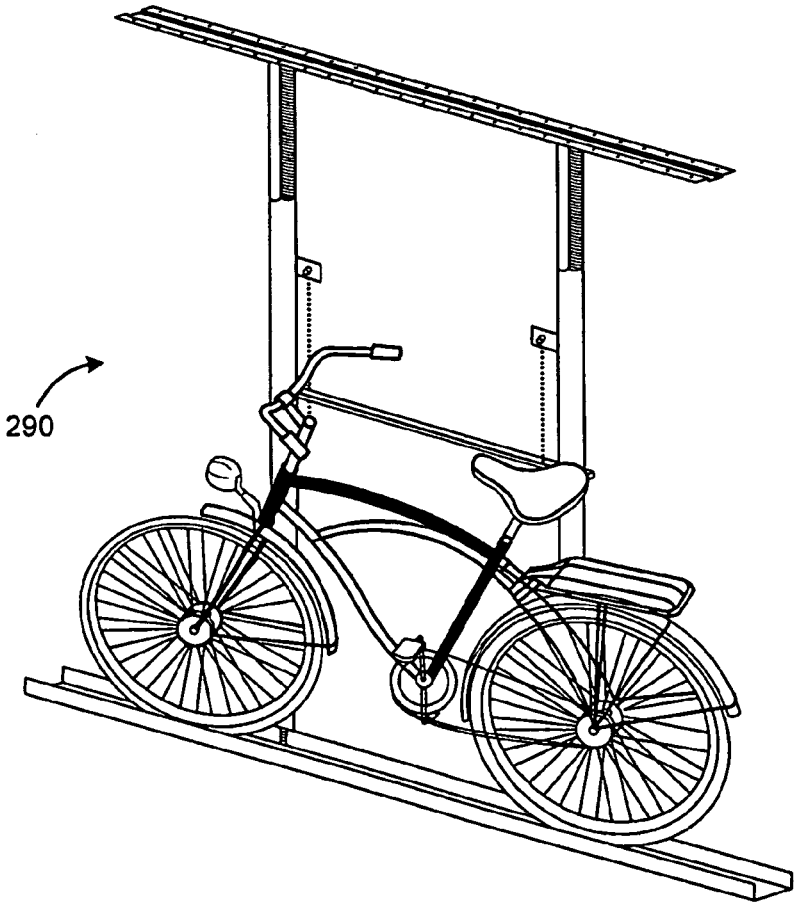
FIG. 9 illustrates a horizontal bike storage system in a substantially vertical loading position with a bicycle loaded thereon.

As illustrated in the perspective view of FIG. 5, horizontal bike storage system 200 is generally comprised of a storage system mounting track 215, a plurality of upper beam members 210, 211 pivotally connected to a plurality of lower beam members 205, 206 that are each connected to a bike lift channel assembly 220. In operation, the tires of the bike are placed into the bike lift channel assembly 220 and the frame of the bike would be secured to lower beam members 205, 206 prior to moving the horizontal bike storage system 200 from a substantially vertical loading position to a substantially horizontal storage position. As an example, FIG. 9 illustrates a horizontal bike storage system 290 in a substantially vertical loading position with a bike loaded thereon. In one embodiment, a plurality of VELCRO® straps (not illustrated) may be used to secure the frame of the bike to lower beam members 205, 206, although, as one of ordinary skill in the art will appreciate, any similar securement means may be used without departing from the scope of the present invention.

Figure 6:
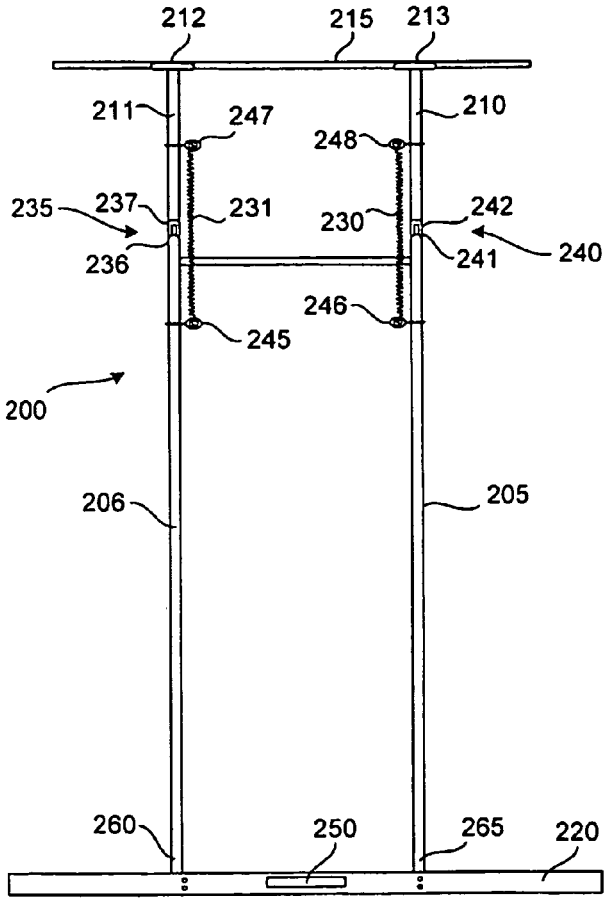
FIG. 6 is a front view showing certain elements of the embodiment of a horizontal bike storage system illustrated in FIG. 5.
Figure 7:
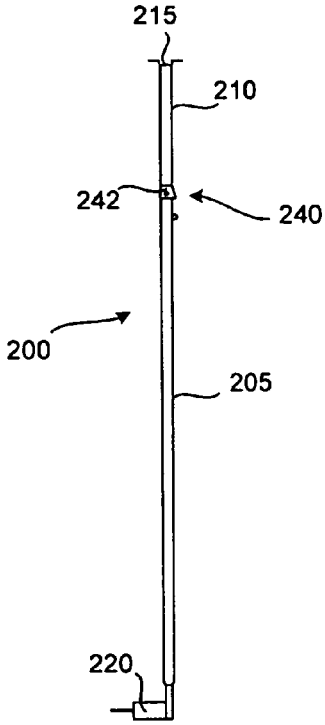
FIG. 7 is a side view showing certain elements of the embodiment of a horizontal bike storage system illustrated in FIG. 5.
Figure 8:
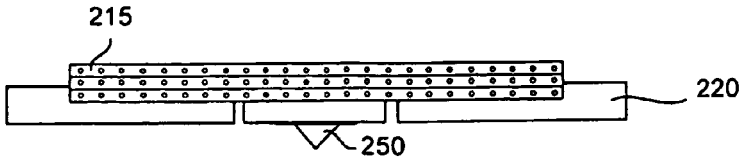
FIG. 8 is a top view of the embodiment of a horizontal bike storage system illustrated in FIG. 5.

FIGS. 6-8 illustrate the various parts of the horizontal bike storage system 200 from a front view of the system, a side view of the system and a top view of the system. Storage system mounting track 215 is configured to be mounted to the joists or similar structure of the ceiling of a garage or the rack member 103 of overhead rack system 100. Upper beam members 210, 211 are coupled to the mounting track 215 using mounting track c-channel members 212, 213, which are, in one embodiment, welded to the upper beam members 210, 211 and then attached to the mounting track 215.

As shown in the illustrated embodiment, upper beam member 210 is pivotally connected to lower beam member 205 using a cam and channel assembly 240. Similarly, upper beam member 211 is pivotally connected to lower beam member 206 using a cam and channel assembly 235. Cam and channel assembly 235 comprises a first cam member 236 that is, in the illustrated embodiment, welded to the lower beam member 206 and a first channel member 237 that is, in the illustrated embodiment, welded to upper beam member 211. The first cam member 236 fits within and rotates relative to the first channel member 237, thereby allowing lower beam member 206 to rotate relative to upper beam member 211. First cam member 236 is held in place relative to first channel member 237 by a pin assembly (not shown). Cam and channel assembly 240 comprises a first cam member 241 that is, in the illustrated embodiment, welded to the lower beam member 205 and a first channel member 242 that is, in the illustrated embodiment, welded to upper beam member 210. The first cam member 241 fits within and rotates relative to the first channel member 242, thereby allowing lower beam member 205 to rotate relative to upper beam member 210. First cam member 241 is held in place relative to first channel member 242 by a pin assembly (not shown).

The horizontal bike storage system 200 additionally comprises a spring-assist lift system to assist the user from moving the horizontal bike storage system 200 from a substantially vertical position when loading a bike, to a substantially horizontal position when storing the bike. Spring-assist lift system is generally comprised of a plurality of springs 230, 231 coupled to the upper beam members 210, 211 and the lower beam members 205, 206 by a plurality of ring assemblies 245, 246, 247, 248, generally comprising a plurality of shafted eye bolts and locking nuts.

In the illustrated embodiment, the first spring-assist lift system of the horizontal bike storage system 200 is comprised of a first spring assembly 231 coupled to the upper beam member 211 using a first ring assembly 247 and coupled to the lower beam member 206 using a second ring assembly 245. In one embodiment, the hole distance for the first ring assembly 247 on the upper beam member 211 is 12" from the mounting track 215, and the hole distance for the second ring assembly 245 on the lower beam member 206 is 12" from the cam and channel assembly 235. Similarly, the second spring-assist lift system of the horizontal bike storage system 200 is comprised of a second spring assembly 230 coupled to the upper beam member 210 using a first ring assembly 248 and coupled to the lower beam member 205 using a second ring assembly 246. In one embodiment, the hole distance for the first ring assembly 248 on the upper beam member 210 is 12" from the mounting track 215, and the hole distance for the second ring assembly 246 on the lower beam member 205 is 12" from the cam and channel assembly 240.

In operation, the first spring assembly 230 of the first spring-assist lift system would expand in the substantially vertical position and contract in the substantially horizontal position when the upper beam member 210 is pivoted relative to lower beam member 205 using cam and channel assembly 240. Similarly, the second spring assembly 231 of the second spring-assist lift system would expand in the substantially vertical position and contract in the substantially horizontal position when the upper beam member 211 is pivoted relative to lower beam member 206 using cam and channel assembly 235. In this manner, the cam and channel assembly and the first and second spring-assist lift systems operate together to assist the user from moving the horizontal bike storage system 200 from a substantially vertical loading position shown in FIG. 9 to a substantially horizontal storage position (not illustrated). In the illustrated embodiment, a pulley attachment point 250 is provided so as to attach the bike lift channel assembly 220 of the horizontal bike storage system 200 to a pulley system (not shown) to assist in the moving of the storage system from a substantially vertical position to a substantially horizontal position.

In the illustrated embodiment, the horizontal bike storage system 200 has the capability of telescoping to increase or decrease its overall size. In the illustrated embodiment, lower extender 260 and lower beam member 206 are constructed of square tubing with a plurality of holes configured to receive a plurality of bolt assemblies (not shown). The square tubing of the lower beam member 206 is sized to be slightly larger in diameter than the square tubing of the lower extender 260 so that the lower extender 260 fits within the lower beam member 206 and is configured to move relative thereto in a telescoping manner. Similarly, lower extender 265 and lower beam member 205 are constructed of square tubing with a plurality of holes configured to receive a plurality of bolt assemblies (not shown). The square tubing of the lower beam member 205 is sized to be slightly larger in diameter than the square tubing of the lower extender 265 so that the lower extender 265 fits within the lower beam member 205 and is configured to move relative thereto in a telescoping manner. The telescoping relationship between the lower beam members 205, 206 relative to the lower extenders 260, 265 allows a user to adjust the distance between the ceiling and the tire rail assembly 220.

FIGS. 10-13 illustrate one embodiment of a horizontal package storage system 300 that may be used in connection with the overhead rack system 100 illustrated and described with respect to FIGS. 1-4. In one embodiment, the horizontal package storage system 300 is constructed using 14 gage powder coated steel, can handle packages up to several hundred pounds, and can be mounted to the garage ceiling taking up little garage ceiling storage space. The horizontal package storage system 300 of the present invention is intended to be a ceiling mounted rack that uses a spring-assist lift system to store a storage container, box, carton or the like in a horizontal storage position. Since the horizontal package storage system 300 is compact, it can also easily be used as a box storage accessory mounted under overhead rack system 100.

Figure 10:
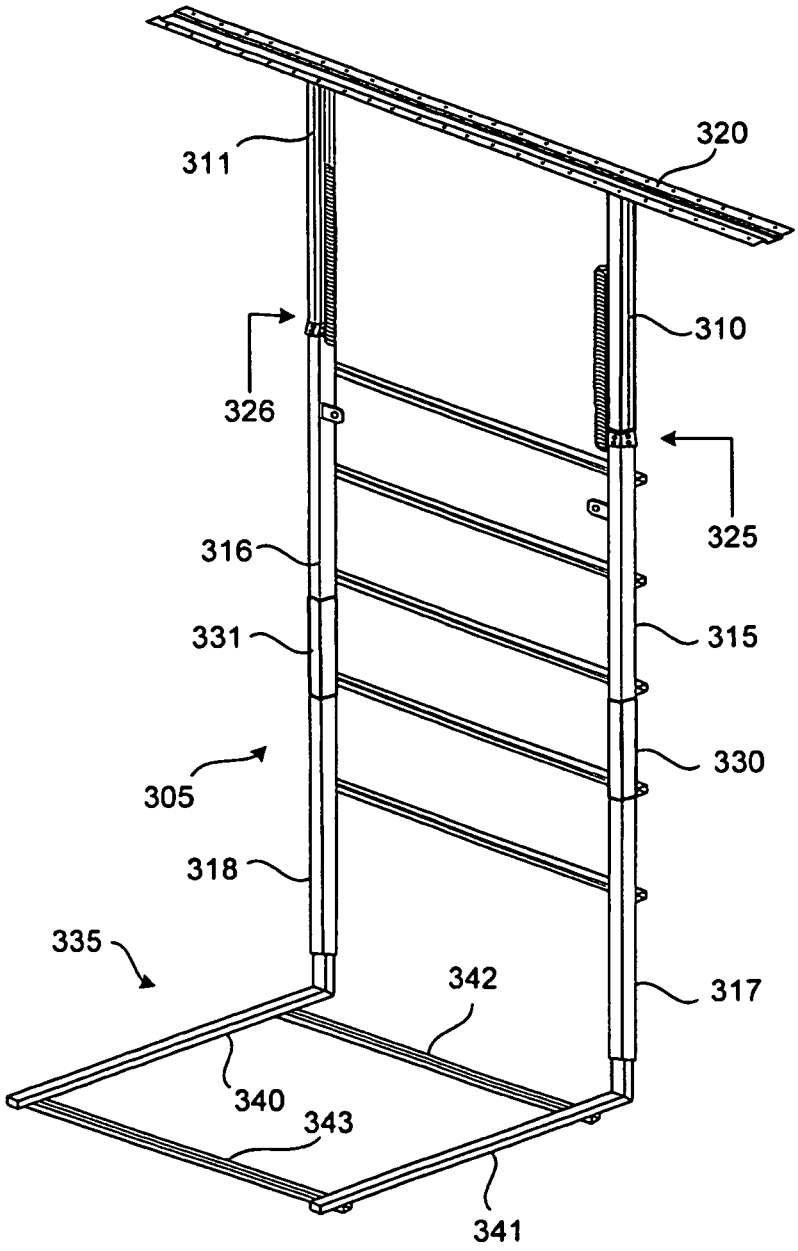
FIG. 10 is a perspective view of one embodiment of a horizontal bike storage system.

As illustrated in the perspective view of FIG. 10, horizontal package storage system 300 is generally comprised of an upper bracket mount 320, a plurality of first upper beam members 310, 311 pivotally connected to a plurality of lower beam members 315, 316, that are each coupled, through second lower beam members 317, 318, to a package base assembly 335. In operation, a box or storage container is placed onto the package base assembly 335 and additional boxes or containers are stacked thereon, and the storage containers are secured to lower beam members 315, 316, 317, 318 prior to moving the horizontal package storage system 300 from a substantially vertical loading position to a substantially horizontal storage position. In one embodiment, a plurality of VELCRO® straps (not illustrated) may be used to secure the boxes to lower beam members 315, 316, 317, 318, although, as one of ordinary skill in the art will appreciate, any similar securement means may be used without departing from the scope of the present invention.

Figure 11:
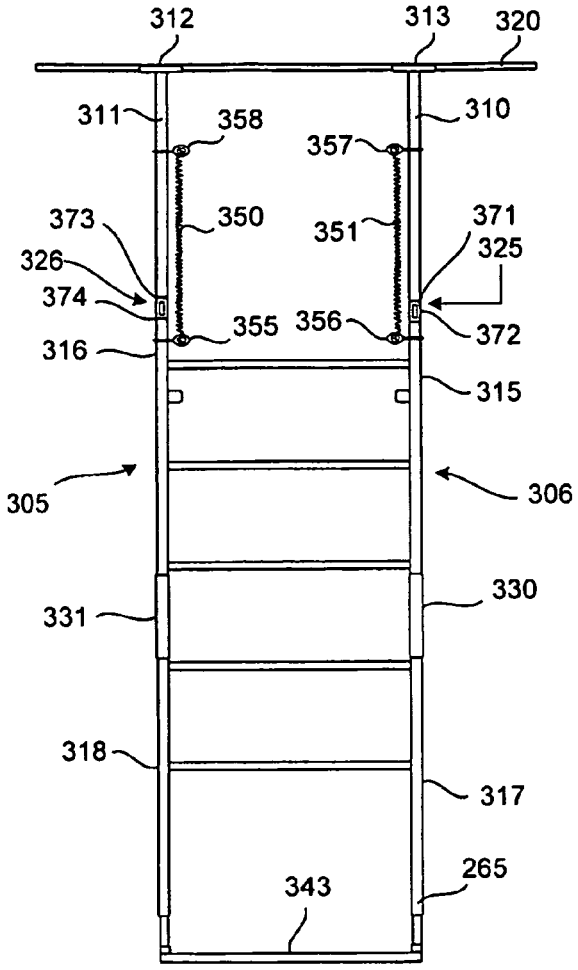
FIG. 11 is a front view showing certain elements of the embodiment of a horizontal package storage system illustrated in FIG. 10.
Figure 12:
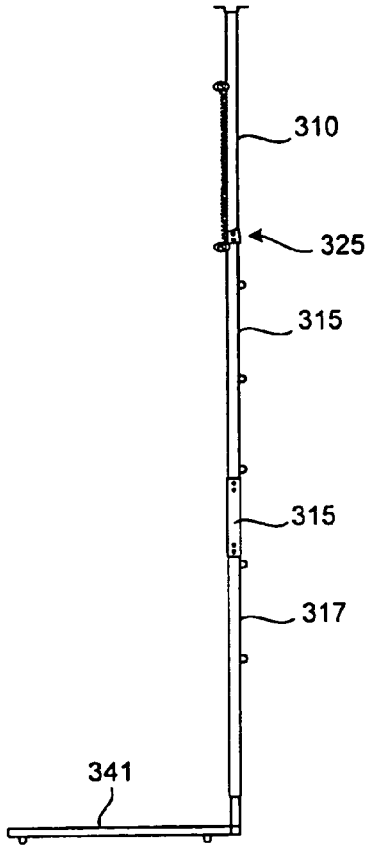
FIG. 12 is a side view showing certain elements of the embodiment of a horizontal package storage system illustrated in FIG. 10.
Figure 13:
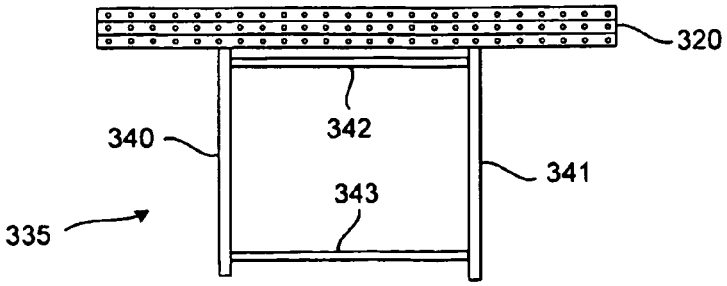
FIG. 13 is a top view of the embodiment of a horizontal package storage system illustrated in FIG. 10.

FIGS. 11-13 illustrate the various parts of the horizontal package storage system 300 from a front view of the system, a side view of the system and a top view of the system. Upper bracket mount 320 is configured to be mounted to the joists or similar structure of the ceiling of a garage or the rack member 103 of overhead rack system 100. Upper beam members 310, 311 are coupled to the upper bracket mount 320 using mounting track c-channel members 312, 313, which are welded to the upper beam members 310, 311 and then attached to the upper bracket mount 320.

In the illustrated embodiment, the horizontal package storage system 300 has a package base assembly 335 that is comprised of a plurality of base members 340, 341, 343 and a lower weldment 342. The first lower beam members 315, 316 are joined to the second lower beam members 317, 318 by a plurality of vertical connectors 330, 331. The use of shorter beam members 315, 316, 317, 318 connected by the vertical connectors 330, 331 increases the overall strength of the individual pieces supporting the weight of the storage containers, thereby increasing the weight of the load that may be handled by the horizontal package storage system 300 when in the substantially horizontal storage position.

As shown in the illustrated embodiment, upper beam member 310 is pivotally connected to first lower beam member 315 using a cam and channel assembly 325. Similarly, upper beam member 311 is pivotally connected to first lower beam member 316 using a cam and channel assembly 326. Cam and channel assembly 325 comprises a first cam member 372 that is, in the illustrated embodiment, welded to the lower beam member 315 and a first channel member 371 that is, in the illustrated embodiment, welded to upper beam member 310. The first cam member 372 fits within and rotates relative to the first channel member 371, thereby allowing first lower beam member 315 to rotate relative to upper beam member 310. First cam member 372 is held in place relative to first channel member 371 by a pin assembly (not shown). Cam and channel assembly 326 comprises a first cam member 374 that is, in the illustrated embodiment, welded to the lower beam member 316 and a first channel member 373 that is, in the illustrated embodiment, welded to upper beam member 311. The first cam member 374 fits within and rotates relative to the first channel member 373, thereby allowing first lower beam member 316 to rotate relative to upper beam member 311. First cam member 374 is held in place relative to first channel member 373 by a pin assembly (not shown).

The horizontal package storage system 300 additionally comprises a spring-assist lift system to assist the user from moving the horizontal package storage system 300 from a substantially vertical position when loading storage containers, to a substantially horizontal position when storing the containers. Spring-assist lift system is generally comprised of a plurality of springs 350, 351 coupled to the upper beam members 310, 311 and the first lower beam members 315, 316. In the illustrated embodiment, the first spring-assist lift system of the horizontal package storage system 300 is comprised of a first spring assembly 351 coupled to the upper beam member 310 using a first ring assembly 357 and coupled to the first lower beam member 315 using a second ring assembly 356. Similarly, the second spring-assist lift system of the horizontal package storage system 300 is comprised of a second spring assembly 350 coupled to the upper beam member 311 using a first ring assembly 358 and coupled to the first lower beam member 315 using a second ring assembly 372.

In operation, the first spring assembly 351 of the first spring-assist lift system would expand in the substantially vertical position and contract in the substantially horizontal position when the upper beam member 310 is pivoted relative to first lower beam member 315 using cam and channel assembly 325. Similarly, the second spring assembly 350 of the second spring-assist lift system would expand in the substantially vertical position and contract in the substantially horizontal position when the upper beam member 311 is pivoted relative to lower beam member 316 using cam and channel assembly 326. In this manner, the cam and channel assembly and the first and second spring-assist lift systems operate together to assist the user from moving the horizontal package storage system 300 from a substantially vertical loading position shown in FIG. 10 to a substantially horizontal storage position (not illustrated).

FIGS. 14-17 illustrate one embodiment of a motorized lift system 400 that may be used in connection with the overhead rack system 100 illustrated and described with respect to FIGS. 1-4. In using the overhead rack system 100, it may be difficult to load heavy items on the rack member 103 by hand. Tool boxes, tires, heavy boxes, and numerous other items may be difficult to carry up a ladder and placed on the rack member 103. The motorized lift system 400 of the present invention provides a way to lift items into position to be stored on the overhead rack system 100. In the illustrated embodiment, the motorized lift system 400 is capable of carrying up to 150 pounds.

Figure 14:
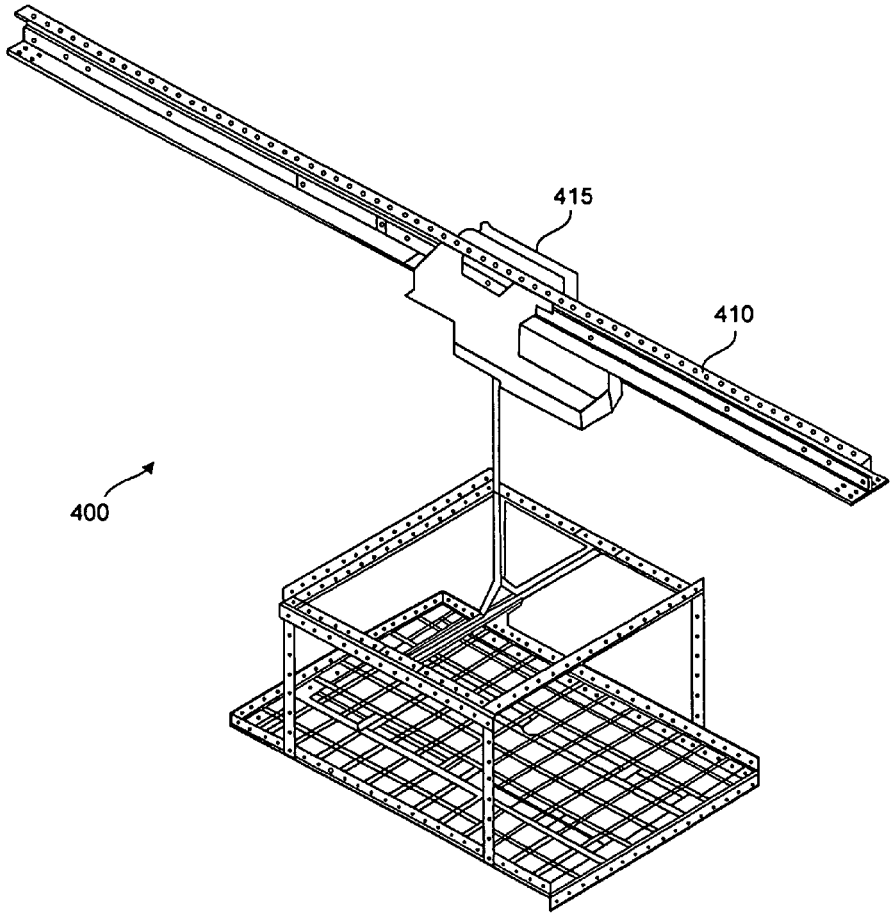
FIG. 14 is a perspective view of one embodiment of a motorized lift system.

As shown in FIG. 14, the motorized lift system 400 is generally comprised of a lift platform 405 coupled to a motor and winch assembly 415, that is in turn mounted to a solid steel track rail 410 that can span the entire garage. Motorized lift system 400 is driven by a powerful winch and motor system 415 so as to make accessing overhead rack system 100 and storing heavy or bulky items thereon a relatively simple task. In operation, once the items are loaded into the platform 405 of the motorized lift system 400, a user operates the controls to move the platform 405 to the desired position on the overhead rack system 100. Once the lift system 400 has moved platform 405 into position, the user can easily slide the items to be stored from the lift platform 405 onto the overhead rack system 100.

Figure 15:
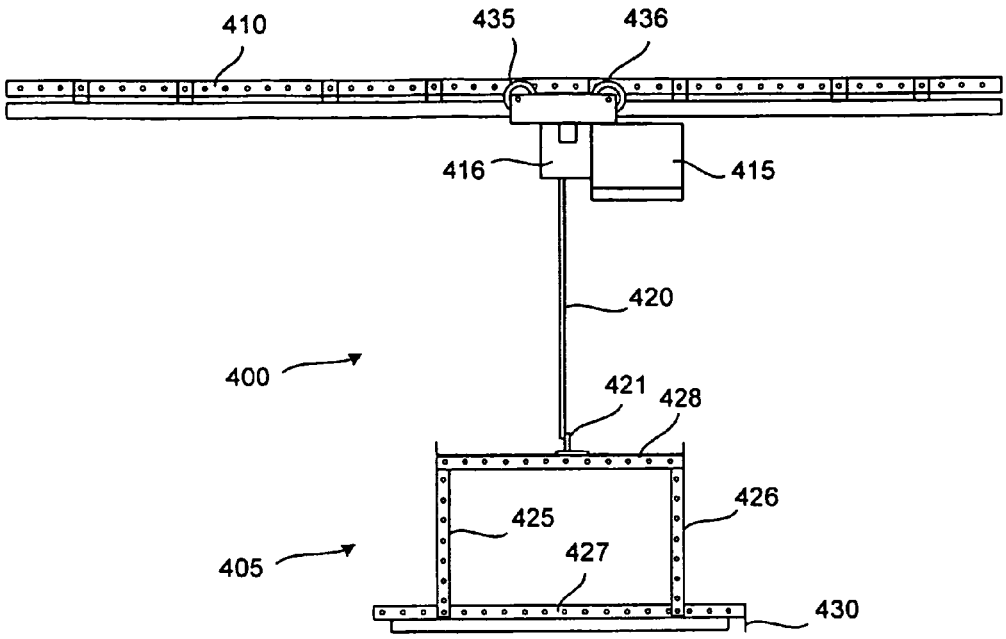
FIG. 15 is a front view showing certain elements of the embodiment of a motorized lift system illustrated in FIG. 14.
Figure 16:
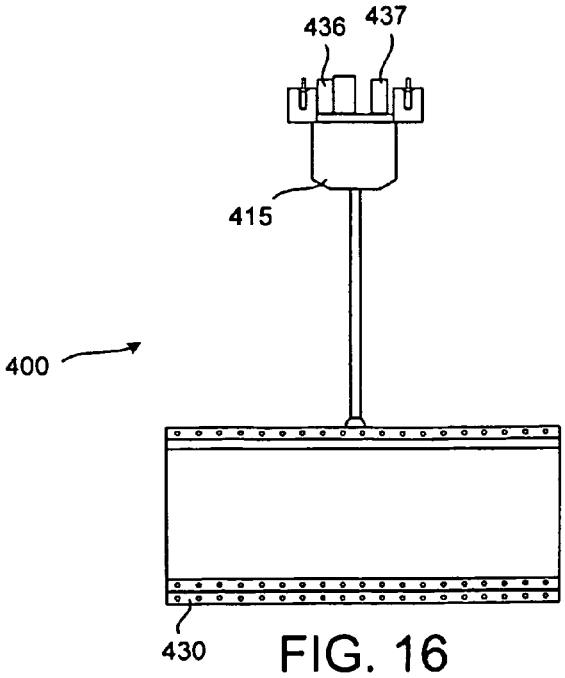
FIG. 16 is a side view showing certain elements of the embodiment of a motorized lift system illustrated in FIG. 14.
Figure 17:
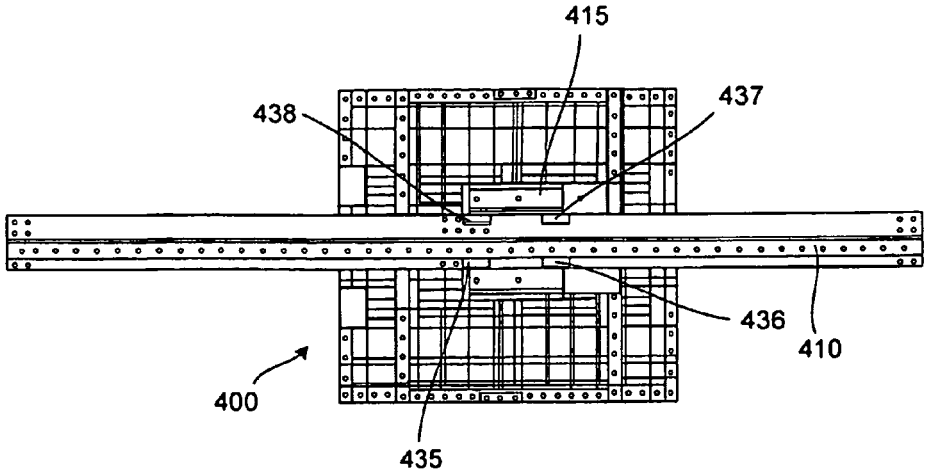
FIG. 17 is a top view of the embodiment of a motorized lift system illustrated in FIG. 14.

FIGS. 15-17 further illustrate a side, front and top view of motorized lift system 400. As illustrated in FIG. 15, lift platform 405 is coupled to motor and winch assembly 415 using a cable 420 that is connected to beam top cross 421. Cable 420 is wound on a spool (not shown) within the winch housing 416. The cable 420 is of sufficient length so as to allow the lift platform to be dropped to a level sufficient for the user to load the heavy or bulky storage item thereon.

Lift platform 405 is constructed of a plurality of base members 427, a plurality of upright members 425, 426 and a plurality of top members 428. In the illustrated embodiment, lift platform 405 is a rectangular shape to accommodate oversized storage containers, however, any shape may be used in accordance with the scope and spirit of the present invention.

Figure 18:
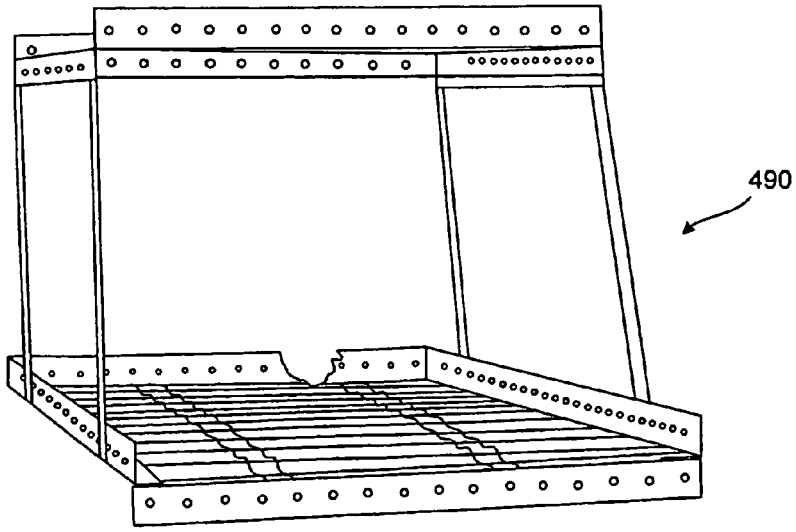
FIG. 18 illustrates a motorized lift system in an unloading position with an overhead rack system.

As shown in FIGS. 15 and 16, the lift platform 405 further comprises a stabilizer edge 430 that is configured to attach to the side rail of a side rail platform of a rack member of the overhead rack system 100. Once the lift platform 405 is in position with the stabilizer edge 430 engaged with the side rail of the side rail platform, the lift platform 405 is stable and the item to be stored may be slid from the surface of the lift platform without the unintended result of the base of the lift platform swinging downward and dumping the item onto the floor. FIG. 18 shows the lift platform 490 engaged with a rack member of an overhead rack system.

FIG. 17 shows the winch and motor system 415 further comprising a plurality of truck wheels 435, 436, 437, 438 for moving the winch and motor system 415 and the lift platform 405 coupled thereto along the entire length of track rail 410. In operation, the user would be provided a control mechanism (not shown) that would operate the up and down movement of the winch system, and the side to side movement of the motorized lift system 400. In another embodiment, the side to side movement may be purely mechanical in nature, thus, the user would simply push the lift platform 405 causing the truck wheels 435, 436, 437, 438 to move along the entire length of track rail 410.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

Similarly, it should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects.

While the invention has been particularly shown and described with reference to various embodiments thereof, it will be understood by those skilled in the art that various other changes in the form and details may be made without departing from the spirit and scope of the invention.

I claim:

1. An overhead rack system comprising:

a plurality of telescoping rack mounting tracks for securing the overhead rack system to one or more ceiling joists of a structure, each telescoping rack mounting track having an upper bracket member and a lower extension assembly each constructed of a square tube material, said lower extension assembly configured to fit within the interior of the upper bracket member and move in a telescoping manner relative thereto;

a rack member having a plurality of rail members coupled together to form a substantially rectangular frame member, at least two of said rail members each comprising a first side rail platform having an end adjacent an end of a second side rail platform and coupled together by a rail connector, said rail connector sized to overlap both said first and second side rail platforms at said adjacent ends;

a first plurality of support bracket members, each support bracket member removably coupled to a lower end of a lower extension assembly of one of the plurality of telescoping rack mounting tracks and a rail member of said rack member; and a drop-in grid assembly supported by said rack member, said drop-in grid assembly configured for supporting items to be stored thereon.

2. The overhead storage system of claim 1, wherein each of said support bracket members further comprises a C-mount support bracket having a wall and rail bracket, a rack member support mount and a lower extension assembly mount, wherein said wall and rail bracket is configured to receive a portion of a side rail platform within a u-shaped portion of said wall and rail bracket and wherein said lower extension assembly mount is configured to secure said C-mount support bracket to said rack mounting track.

3. The overhead storage system of claim 1, wherein said telescoping movement provides an adjustable distance between said ceiling joists and an end of the mounting track opposite said location where said mounting track is mounted to said ceiling joists of said structure, wherein said support bracket member is removably coupled to the lower extension assembly.

4. The overhead rack system of claim 1, wherein said substantially rectangular frame member has a channel running along its perimeter configured to receive and support the drop-in grid assembly configured for supporting items to be stored thereon.

5. The overhead rack system of claim 1, wherein said first plurality of support bracket members further comprises:

a u-shaped wall and rail bracket configured to receive said square tubed lower extension assembly within an interior of a channel of said u-shaped bracket;

a rack member support mount; and a lower extension assembly mount configured to secure said u-shaped wall and rail bracket to said square tubed lower extension assembly.

6. The overhead rack system of claim 1, wherein said first and second side rail platforms have a front face with at least one hole therein, wherein each rail connector has at least a front face with a plurality of holes therein, wherein said at least one hole in the front face of said first and second side rail platforms is configured to align with one or more holes of said plurality of holes in the front face of said rail connector.

7. The overhead rack system of claim 6, wherein said first and second side rail platforms have a bottom support portion for supporting said drop-in grid assembly, said bottom support portion of said first and second side rail platforms having at least one hole therein, wherein each rail connector has a bottom support portion with a plurality of holes therein, wherein said at least one hole in the bottom support portion of said first and second side rail platforms is configured to align with one or more holes of said plurality of holes in the bottom support portion of said rail connector.

8. The overhead rack system of claim 7, wherein said rail members, said first and second side rail platforms and said rail connector are L-shaped.

9. A method of providing an overhead rack system comprising:

providing a plurality of telescoping rack mounting tracks configured for securing the overhead rack system to ceiling joists of a structure, each telescoping rack mounting track having an upper bracket member and a lower extension assembly each constructed of a square tube material, said lower extension assembly configured to fit within the interior of the upper bracket member and move in a telescoping manner relative thereto;

providing a rack member having a plurality of rail members configured to be coupled together to form a substantially rectangular frame member, at least two of said rail members each having a first side rail platform having an end adjacent an end of a second side rail platform and configured to be coupled together by a rail connector, said rail connector sized to overlap both said first and second side rail platforms at said adjacent ends;

providing a first plurality of support bracket members, each support bracket member configured to be removably coupled to a lower end of one of the plurality of telescoping rack mounting tracks and a rail member of said rack member; and providing a drop-in grid assembly configured to be supported by said rack member, said drop-in grid assembly configured for supporting items to be stored thereon.

10. The method of providing an overhead rack system of claim 9, further comprising providing a second plurality of said second support bracket members, each support bracket member configured to be coupled to a wall stud of said structure and a rail member of said rack member.

11. The method of providing an overhead rack system of claim 9, wherein providing said support bracket member further comprises providing a C-mount support bracket having a wall and rail bracket, a rack member support mount and a lower extension assembly mount, wherein said wall and rail bracket is configured to receive a portion of a side rail platform within a u-shaped portion of said wall and rail bracket and wherein said lower extension assembly mount is configured to secure said C-mount support bracket to said rack mounting track.

12. The method of providing an overhead rack system of claim 9, wherein providing said mounting track further comprises providing an upper bracket member and a lower extension assembly, said lower extension assembly configured to fit within the interior of the upper bracket member and move in a telescoping manner relative thereto, said telescoping movement providing an adjustable distance between said ceiling joists and an end of the mounting track opposite said location where said mounting track is mounted to said ceiling joists of said structure, wherein said support bracket member is coupled to the lower extension assembly.

13. The method of providing an overhead rack system of claim 9, further comprising providing said substantially rectangular frame member with a channel running along its perimeter configured to receive and support the drop-in grid assembly configured for supporting items to be stored thereon.

14. An overhead rack system comprising:

a plurality of rack mounting tracks for securing the overhead rack system to one or more ceiling joists of a structure, each rack mounting track having an upper bracket member constructed of a square tube material and a lower extension assembly, said lower extension assembly configured to fit within the interior of said upper bracket member and move in a telescoping manner relative thereto, said lower extension assembly being enclosed by said upper bracket member when it is within said interior;

a rack member having a plurality of rail members coupled together to form a frame member, at least two of said rail members each comprising a first side rail platform having and end adjacent an end of a second side rail platform and coupled together by a rail connector, said rail connector sized to overlap said first and second side rail platforms, said rail connector configured to be removably coupled to both said first and second side rail platforms;

a first plurality of support bracket members, each said first support bracket member removably coupled to a lower end of one of the plurality of mounting tracks or a wall stud of said structure, said support bracket member coupled to a rail member of said rack member; and a drop-in grid assembly supported by said rack member, said drop-in grid assembly configured for supporting items to be stored thereon.

15. The overhead storage system of claim 14, wherein said support bracket member further comprises a C-mount support bracket having a wall and rail bracket, a rack member support mount and a lower extension assembly mount, wherein said wall and rail bracket is configured to receive a portion of a side rail platform within a u-shaped portion of said wall and rail bracket and wherein said lower extension assembly mount is configured to secure said C-mount support bracket to said rack mounting track or said wall stud.

16. The overhead storage system of claim 14, wherein said telescoping movement providing an adjustable distance between said ceiling joists and an end of the mounting track opposite said location where said mounting track is mounted to said ceiling joists of said structure, wherein said support bracket member is removably coupled to the lower extension assembly.

17. The overhead rack system of claim 14, wherein said frame member has a channel running along its perimeter configured to receive and support the drop-in grid assembly configured for supporting items to be stored thereon.

18. The overhead rack system of claim 14, wherein said first and second side rail platforms have a front face with at least one hole therein, wherein each rail connector has at least a front face with a plurality of holes therein, wherein said at least one hole in the front face of said first and second side rail platforms is configured to align with one or more holes of said plurality of holes in the front face of said rail connector.

19. The overhead rack system of claim 18, wherein said rail members, said first and second side rail platforms and said rail connector are L-shaped.

20. The overhead rack system of claim 19, wherein said first and second side rail platforms have a bottom support portion for supporting said drop-in grid assembly, said bottom support portion of said first and second side rail platforms having at least one hole therein, wherein each rail connector has a bottom support portion with a plurality of holes therein, wherein said at least one hole in the bottom support portion of said first and second side rail platforms is configured to align with one or more holes of said plurality of holes in the bottom support portion of said rail connector.

21. An overhead rack system comprising:

a plurality of telescoping rack mounting tracks for securing the overhead rack system to one or more ceiling joists of a structure, each telescoping mounting track having a ceiling mount connected to a square tubed shaped upper bracket member, each telescoping mounting track having a square tubed shape lower extension assembly disposed within the interior of said square tubed shaped upper bracket member, said lower extension assembly configured to slide within the interior of the upper bracket member and move in a telescoping manner relative thereto providing an adjustable distance between said ceiling joists and an end of the lower extension assembly opposite where said telescoping rack mounting track is mounted to said ceiling joists of said structure;

a rack member having a plurality of rail members coupled together to form a substantially rectangular frame member, at least two of said rail members each comprising a first side rail platform having an end adjacent an end of a second side rail platform and coupled together by a rail connector, said rail connector sized to overlap both said first and second side rail platforms at said adjacent ends;

a first plurality of support bracket members, each support bracket member removably coupled to a lower end of one of the lower extension assembly of said plurality of telescoping rack mounting tracks and a rail member of said rack member; and a drop-in grid assembly supported by said rack member, said drop-in grid assembly configured for supporting items to be stored thereon.

* * * * *